US011660244B2

(12) United States Patent
Fleumer et al.

(10) Patent No.: US 11,660,244 B2
(45) Date of Patent: May 30, 2023

(54) MEMORIAL INTERNMENT VESSEL

(71) Applicants: Colin Fleumer, Petaluma, CA (US); Michelle Royall, Petaluma, CA (US)

(72) Inventors: Colin Fleumer, Petaluma, CA (US); Michelle Royall, Petaluma, CA (US)

( * ) Notice: Subject to any disclaimer, the term of this patent is extended or adjusted under 35 U.S.C. 154(b) by 0 days.

(21) Appl. No.: 17/230,136

(22) Filed: Apr. 14, 2021

(65) Prior Publication Data

US 2022/0133574 A1 May 5, 2022

Related U.S. Application Data

(60) Provisional application No. 63/107,481, filed on Oct. 30, 2020.

(51) Int. Cl.
*A61G 17/08* (2006.01)

(52) U.S. Cl.
CPC ..... *A61G 17/08* (2013.01)

(58) Field of Classification Search
CPC ..... A61G 17/08; F21V 35/00; F21V 33/0028; F21V 33/00; E04H 13/008
USPC ..... 27/1; 362/154, 161
See application file for complete search history.

(56) References Cited

U.S. PATENT DOCUMENTS 1,484,964 A * 2/1924 Benneville ..... F21V 35/00 431/126
5,688,040 A * 11/1997 Klees ..... F21L 19/00 362/180
5,704,103 A * 1/1998 Crowley ..... E04H 13/003 40/124.5
5,729,921 A * 3/1998 Rojas ..... E04H 13/006 27/1
5,813,098 A * 9/1998 Schneider ..... E04H 13/006 431/297
6,044,532 A * 4/2000 Bowling ..... A61G 17/08 108/150
6,241,362 B1 * 6/2001 Morrison ..... H05B 45/20 362/101
6,785,939 B1 * 9/2004 James ..... A61G 17/007 431/298
7,174,611 B1 * 2/2007 Rose ..... A61G 17/08 27/1
7,343,653 B2 * 3/2008 Cunningham ..... A61G 17/0407 27/1
2005/0024859 A1 * 2/2005 Micele ..... B44F 1/10 362/161
2006/0179623 A1 * 8/2006 Robinson ..... A61G 17/007 27/1

(Continued)

FOREIGN PATENT DOCUMENTS

WO WO-2017181220 A1 * 10/2017

*Primary Examiner* — William L Miller
(74) *Attorney, Agent, or Firm* — Brennan, Manna & Diamon. LLC

(57) ABSTRACT

The present invention relates generally to the field of memorial or internment vessels used to store ashes of a cremated individual, pet or other precious items. The memorial internment vessel is also equipped with a battery-operated eternal flame, illumination or other lighting feature, a speaker, wireless communication module, LED lighting and remote control capability. The candle-like memorial internment vessel of the present invention allows an individual to turn on a light located along the vessel for an extended period time, while simultaneously storing the ashes of a loved one or other precious item.

1 Claim, 6 Drawing Sheets

(56) References Cited

U.S. PATENT DOCUMENTS

| | | | | |
|---|---|---|---|---|
| 2007/0207427 | A1* | 9/2007 | Robinson | F23D 3/16 431/291 |
| 2012/0047699 | A1* | 3/2012 | Creager | A61G 17/08 27/1 |
| 2015/0013123 | A1* | 1/2015 | Lynch | A61G 17/08 27/1 |
| 2015/0128391 | A1* | 5/2015 | Lynch | F21V 35/00 27/1 |
| 2016/0263613 | A1* | 9/2016 | Lin | F21S 10/04 |
| 2016/0378245 | A1* | 12/2016 | Montgomery | E04H 13/008 345/173 |
| 2017/0191654 | A1* | 7/2017 | Lynch | F21S 9/02 |
| 2019/0017695 | A1* | 1/2019 | Goldstein | H04R 1/028 |
| 2020/0154721 | A1* | 5/2020 | Piccionelli | A23G 3/563 |

* cited by examiner

MEMORIAL INTERNMENT VESSEL

CROSS-REFERENCE TO RELATED APPLICATION

The present application claims priority to, and the benefit of, U.S. Provisional Application No. 63/107,481, which was filed on Oct. 30, 2020, and is incorporated herein by reference in its entirety.

FIELD OF THE INVENTION

The present invention relates generally to the field of memorial or internment vessels used to store ashes of a cremated person, pet or other precious items. More specifically, the present invention relates to a type of container or other device equipped with a battery-operated eternal flame, illumination or other lighting feature, speaker, communication module, LED lighting and remote control capability. The candle-like device of the present invention allows a user to turn on a light located in the device for an extended period time, while simultaneously storing the ashes of a loved one or other precious item.

More specifically, a user can illuminate the commemorative device in remembrance of a loved one while knowing that the cremated remains or other memento of the loved one are within the device. Additionally, the device may have a speaker for the user to play music, a sound, or prerecorded message, and the capability of wireless communication to enable the user to remotely control the various functions of the device from a mobile application on a remote electronic device. Still further, the device may have a memory and one or more sensors to detect, for example, motion, light and/or sound which will then trigger activation of the device. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, many individuals desire to remember or honor a loved one after the loved one passes away, or if the deceased is not conveniently located near the individuals. Accordingly, many such individuals will typically light candles in remembrance of a loved one who has died or left. Unfortunately, it is not always feasible or practical to keep a candle burning for a prolonged length of time. For example, keeping a candle burning for an extended period of time may cause a safety hazard, or the candle could become unintentionally extinguished, for example, by the wind. Additionally, actual candles have to be frequently replaced when, for example, they fully burn through the length of the candle or wick, and may also leave wax or other debris behind.

In addition, individuals who received the cremated ashes of a loved one oftentimes place those ashes in large urns or other containers that may be cumbersome to handle and may not blend in well with the individual's home decor. Those urns are then, generally, eventually buried in burial plots. A typical urn is also shaped like a vase with a smaller base, wider middle that extends up to an opening that usually has a lip. Although these urns can be decorative, there is generally no ability to place a candle or other lighting or illumination feature on the urn. Accordingly, an individual would need to purchase a separate candle to place near the urn to light if the individual desires to honor the loved one in such a way, and the two objects could become separated or otherwise displaced.

Another limitation of a standard urn is the inability to have music, a recorded message or the like emerge or be emitted from the urn. More often than not, an individual will want to hear a favorite song, a calming sound, a biblical passage, poetry, other readings or a pre-recorded message while remembering the loved one. With the standard urn, like a candle, the individual would need to have a separate device to play the music, sound, or message which would now result in the need for the individual to purchase and display three separate device. In addition, having three separate devices may prevent the individual from placing the loved one's cremated ashes or other memorabilia in a desirable place.

Therefore, there exists a long felt need in the art for a memorial vessel, container or other device that allows a user to place the cremated ashes or other personal items of a loved one inside the device while also being able to simulate the flame of a candle. More specifically, there is a long felt need in the art for a memorial vessel, container or device that is both capable of illumination and that contains a space in which to place the cremated ashes or other personal items of a loved one for remembrance. Additionally, there is a long felt need in the art for a simulated flame or other illumination device that also provides a mechanism to allow the user to listen to music, sounds, poetry, readings, religious passages or messages without requiring the user to have to purchase and then display yet another separate device. Moreover, there is a long felt need in the art for a memorial vessel, remembrance or other keepsake device that provides a mechanism to illuminate the vessel or device through the use of a battery to avoid the safety hazard of having an actual open flame exposed for extended periods of time, and to prevent the same from becoming unintentionally extinguished. Finally, there is a long felt need in the art for a remembrance device that is relatively inexpensive to manufacture, provides a suitable chamber for personal or precious items and that is both safe and easy to use.

The subject matter disclosed and claimed herein, in one embodiment thereof, comprises a remembrance vessel or memorial container that is comprised of a body, which may be cylindrical in shape or have other geometric configurations, base and a bulb. The body is relatively lightweight and supported by a detachable base. In one embodiment, the body is generally a cylindrical shape to emulate the look of a pillar candle. The remembrance vessel is further comprised of a base that fastens or is otherwise secured to the bottom or lower surface of the body. The base further contains a hollowed area in which an individual may place the cremated ashes or other precious items of a loved one or any other memento or item the individual desires to secure in a discreet manner. Moreover, the memorial vessel may also have a battery-powered speaker system whereby music, a sound, readings, poetry or a personal message or voice play back of the deceased may be heard from the vessel.

In this manner, the novel remembrance device of the present invention accomplishes all of the forgoing objectives and provides a relatively safe, easy, convenient and cost-effective solution to allow a user to remember and honor a loved one in a safe and respectful manner and display a simulated flame or light while doing so. The novel remembrance device also provides the user with the ability to listen to music, sounds, readings, poetry or a message while remembering and honoring a loved one.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a remembrance vessel that allows a user to have an illumination feature, such as a candle, without the use of an open flame in order to remember and honor a loved one. The vessel may also store the cremated ashes, precious relics or other mementos of a loved one. The vessel is comprised of a body and a base. The vessel body is preferably formed from a rigid and durable material and may be provided with graphics that simulate or mimic a particular object. The body is generally geometrically shaped, and in one embodiment emulates that of a pillar candle. Nonetheless, other geometric configurations may include, without limitation, a square, hexagon, triangle, rectangle or any other shape that the individual desires. The body may also be customizable and may be comprised of any material suitable to achieve a particular effect.

In addition, the body may include other deformable or shapable elements to allow an individual to physically interact with the vessel, such as through holding or caressing it. The deformable material may be a foam rubber material adhered to the exterior of the surface and may form fit to the hand of the holder so that the individual can feel connected to the vessel in a personal way. An outer shell for the body of the vessel may also be constructed to allow for style and seasonal changes to the appearance of the vessel.

The body may also have a switch, button or sensor to turn on the bulb and/or sound portion of the device. The body may also contain a speaker in which to hear music, sounds or a prerecorded message. The sensor may be motion, light or sound activated. In addition, the body may contain a timer so that the message is played at certain pre-defined times. The body may further include a video screen to allow photos or other videos to be displayed in a loop or other arrangement on an exterior surface of the vessel.

As noted above, the vessel of the device has a hollow portion where an individual can place the cremated ashes or other memento, relics, or precious items of a loved one and may further comprise a lock for securing the same therein. The base is preferably attached to the body through a threading system, or other fastening mechanism that will allow the base to firmly connect and be secured to the body portion. The base may also include one or more dimples or other indentions along the outside to allow a user to comfortably yet securely hold or grip the vessel, and to be able to separate the base from the main body of the remembrance vessel as needed. As stated above with respect to the body, the base may also contain a switch, button or sensor to turn on the bulb or illumination feature or the sound or video portion of the vessel, and a wireless communication module. The user may use the wireless communication module to pair the vessel to a remote control or mobile application on an electronic device, such as a smart phone, to activate the video, illumination, music and/or sound features of the vessel.

In a further embodiment of the present invention, the remembrance vessel is comprised of a bulb or illumination feature that can be turned on or illuminated when the owner desires. The bulb or illumination feature is preferably fastened to the body by inserting the threads on the bottom of the bulb into the corresponding threads in the bulb opening. The bulb may also be snapped or plugged into place in the bulb opening. Once inserted, the bulb or illumination feature would connect with a power supply, such as a battery, that would allow the bulb or illumination device to turn on when engaged. Alternatively, the remembrance vessel may also include a traditional plug so that the vessel can be used without a battery. As previously stated, the power to the bulb may be turned on through the use of a switch, button, or simply by engagement in the bulb opening. Alternatively, the power may be turned on remotely via the mobile application that is in wireless communication with the wireless communication module of the remembrance vessel. The illumination feature may cycle through several sequences such as a first sequence when it is on, a second sequence when it is off, a third sequence when the light flickers and a fourth sequence when the light is in a dimmed or lower power mode.

In a still further embodiment of the present invention, the remembrance vessel device also comprises a battery compartment. The battery compartment is of a size and shape suitable for an ample number of batteries to fit completely inside the compartment. Once installed, the batteries would connect to a circuit system connected to the bulb or illumination feature, the sound emitter, wireless communication module and any other component that requires electrical power to function. The circuit system may also connect to a switch, button or sensor which, when turned on, would allow the current to flow directly to, and light up, the bulb or power another component. The battery may be disposable or rechargeable and may include any size battery including, without limitation, AAA, AA, C, D or 9-volt batteries. When not using battery power, the compartment may contain other keepsakes or memorabilia in a secure manner and may comprise a lock that is only accessible by the owner.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
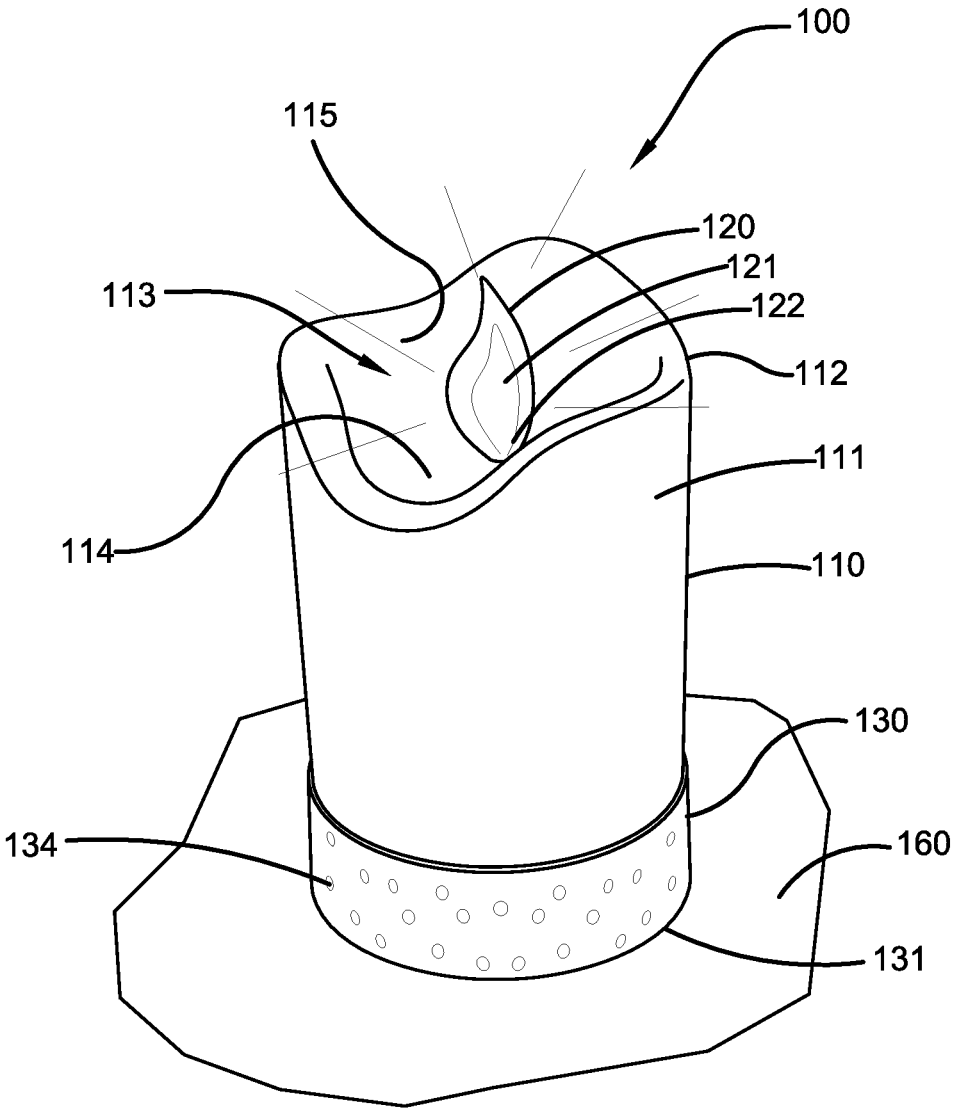
FIG. 1 illustrates a perspective view of one potential embodiment of the memorial internment vessel of the present invention in accordance with the disclosed architecture, wherein the vessel is placed on a hard surface and the bulb is illuminated or in a first sequence.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a memorial internment vessel that allows a user to place the cremated ashes or other personal items of a loved one inside the vessel, while also simulating the flame of a candle. More particularly, there is a long felt need in the art for a memorial internment vessel that is both capable of illumination and that contains a space in which to place the cremated ashes or other personal items of a loved one for remembrance. Additionally, there is a long felt need in the art for a simulated flame or other illumination device that also provides a mechanism to allow the user to listen to music, sounds, poetry, readings, religious passages or a message without requiring the user to have to purchase and then display yet another separate device. Moreover, there is a long felt need in the art for a memorial vessel, remembrance or other keepsake device that provides a mechanism to illuminate the vessel or device through the use of a battery to avoid the safety hazard of having an actual open flame exposed for extended periods of time, and to prevent the same from becoming unintentionally extinguished. Finally, there is a long felt need in the art for a remembrance device that is relatively inexpensive to manufacture, provides a suitable chamber for personal or precious items and that is both safe and easy to use.

Referring initially to the drawings, FIG. 1 illustrates a perspective view of one potential embodiment of the memorial internment vessel 100 of the present invention in accordance with the disclosed architecture, wherein the vessel 100 is placed on a hard surface 160 and the bulb 120 is illuminated or in a first sequence. The memorial internment vessel 100 is comprised of a body 110, a base 130 and at least an illumination feature or bulb 120. More specifically, the vessel 100 of the present invention has a base 130 that includes a cavity or hollow portion 135 for holding the interned materials or other items in a secured manner, wherein the base 130 is removably fastened to the body 110 to prevent the contents or other interned materials of the base 130 from spilling or falling out of the base 130.

As best shown in FIGS. 1 through 5, the body 110 is comprised of a sidewall 111, upper rim 112, inside base 114, inner wall 115, and an underside 117. The body 130 is preferably made of plastic, but made be made of glass, metal, composites or any other suitable material that would emulate a pillar candle or other suitable configuration. Wax may also surround the body 130 providing for a more authentic candle-like appearance. The body 110 is also preferably a cylindrical shape and of a size that is appropriate to set on a table, mantel, bookshelf, desk or other place that is easily accessible display area. Nonetheless, the shape and size of the body 110 is not so limited, and the body 110 may be of any shape and/or size that satisfies user need and/or preference. For example, the body 110 may take on a configuration of a favorite animal, pet, plant, tree, building or the like, to facilitate perpetuation of a memory.

The sidewall 111 extends upward from the underside 117 to an upper rim 112, and the upper rim 112 may be a curvature pattern around the circumference of the body 110, similar to that of a melting candle. That is, the edges may be scalloped or shaped to simulate the melting that occurs with a wax candle as the heat slowly melts the sides of the candle away. Nonetheless, the sidewall 111 is not so limited, and may be any design or configuration that suits user need and/or preference, such as a column or square. In addition, an outer shell (not shown) that is roughly the same size and shape as the sidewall 111 may be removably placed around the sidewall 111, thereby providing a changeable decorative or seasonal pattern without having to change the appearance of the sidewall 111 itself.

The vessel 100 may also include a speaker to emit music, sounds, poetry, prayers or other recorded messages from the vessel 100. In order to emit the music, sounds or a recorded message, the vessel 100 may have a switch, button, motion sensor or the user may gently touch the vessel 100 either on the body 110 or the base 130. In addition, the individual may also download a mobile application on a smartphone or other remote electronic device to operate the music, sound, video or recorded message feature of the vessel 100 via a wireless communication module contained in the vessel, as explained more fully below. Alternatively, a hand-held remote control may also be used to operate the music, sound, video or recorded message feature of the vessel 100, or any other component.

Figure 2:
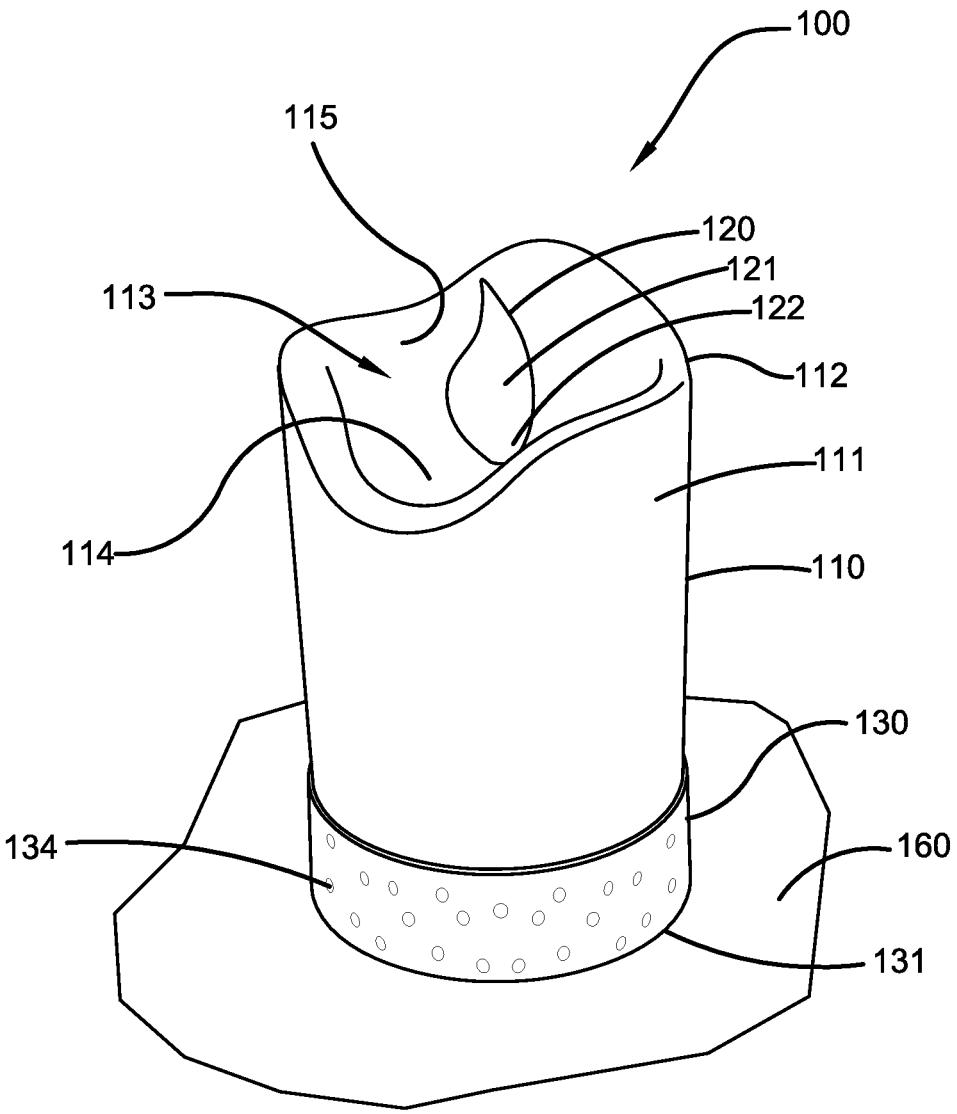
FIG. 2 illustrates a perspective view of one potential embodiment of the memorial internment vessel of the present invention in accordance with the disclosed architecture, wherein the vessel is placed on a hard surface and the bulb is not illuminated or in a second sequence.
Figure 5:
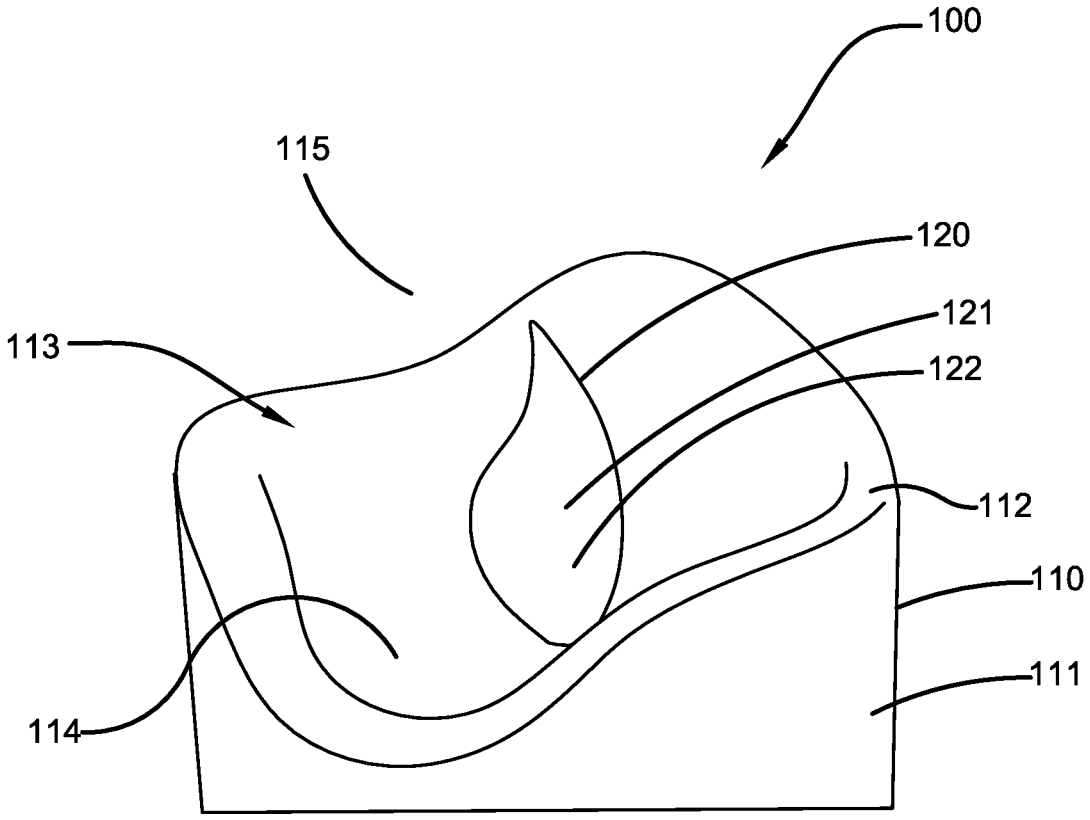
FIG. 5 illustrates a partial perspective view of one potential embodiment of the illumination feature of the memorial internment vessel of the present invention in accordance with the disclosed architecture.

As best illustrated in FIGS. 1, 2 and 5, the top of the body 110 is further comprised of a top opening 113, an inside base 114 and an inner wall 115. The inner wall 115 is preferably the same shape as the body 110, and also resembles that of the inside of a melting candle. The bulb body 121 is preferably shaped to resemble the flame on a candle, but may be any design or shape of a light that the user desires. In a preferred embodiment, the bulb 120 is located in the center of the inside base 114 and is inserted into a bulb opening 122 that is capable of receiving the bulb 120. The battery 150 powers or illuminates the bulb 120 such that when the bulb 120 is illuminated, as shown in FIG. 1, it resembles a flame or, when not illuminated, as shown in FIG. 2, the bulb 120 blends into the device 100. Furthermore, the inner walls 115 are designed to reflect the light from the bulb 120, thereby simulating a flickering candle flame and may include a reflective material, such as a prismatic film available from 3M or Avery Dennison to further reflect the light.

As further shown in FIGS. 1 through 4, in a preferred embodiment, the base 130 is of a similar shape as the body 110. The base 130 may be constructed of metal, as shown in FIGS. 1 through 4, plastic, alloy or other similar material that is capable of supporting the body 110 in an upright position. The base 130 may also contain dimples 134 which allow a user to securely hold or grasp the vessel 100 in a way that decreases the risk of the user dropping the vessel 100.

Figure 3:
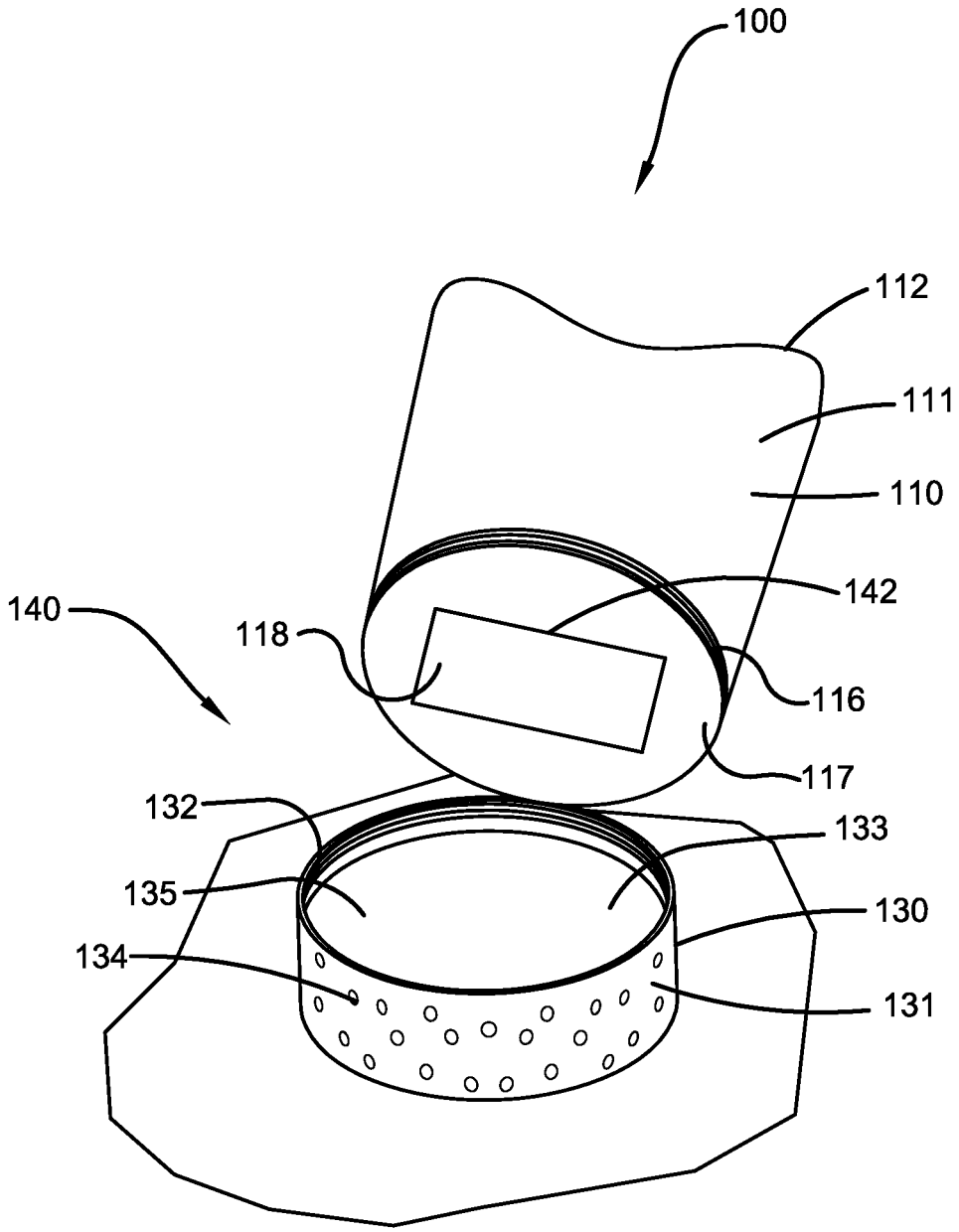
FIG. 3 illustrates a perspective view of one potential embodiment of the memorial internment vessel of the present invention in accordance with the disclosed architecture, wherein the base of the vessel is separated from the body in an open position and ready to receive and store contents.
Figure 4:
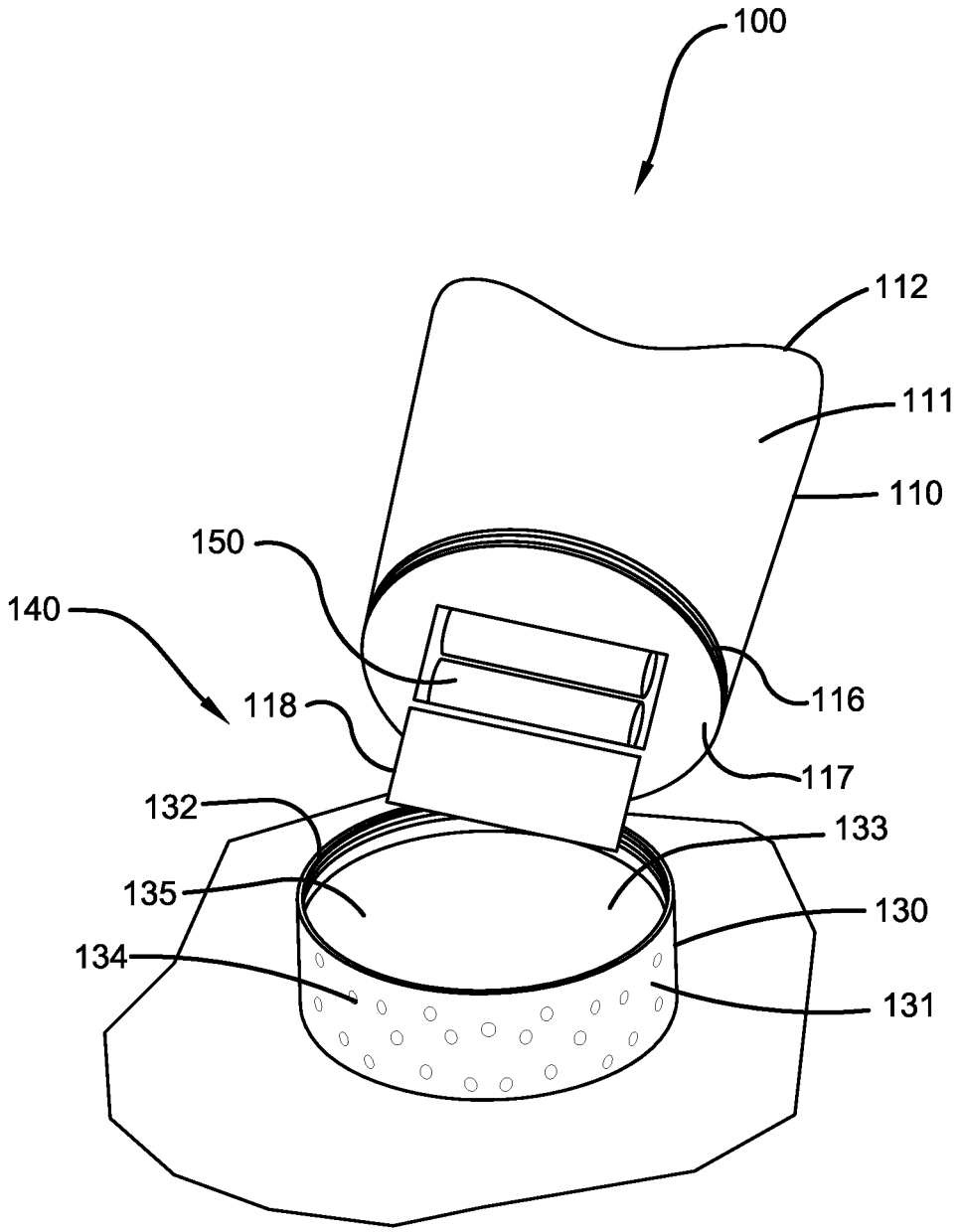
FIG. 4 illustrates a perspective view of one potential embodiment of the memorial internment vessel of the present invention in accordance with the disclosed architecture, wherein the base of the vessel is separated from the body in an open position and ready to receive and store contents and the battery door is open to expose the batteries.

As best shown in FIGS. 3 and 4, the base 130 is comprised of a side wall 131, an inner base 133, a hollow portion 135 and a plurality of receiving threads 132. As noted above, the sidewall 131 is preferably, but not required to be, the same size and shape as the body 110. The hollow portion 135 is capable of accepting items to be interned, such as cremated remains, mementos, precious objects or any other item the user desires to place in the space. In a preferred embodiment, the base 130 fastens to the body 110 through receiving threads 132 on the base 130 and complimentary threads 116 on the body 110. However, the base 130 may be fastened to the body 110 by any other suitable fastening means that provides a secure and tight enclosure that prohibits the contents of the base 130 from spilling or falls out of the device 100 such as a snap connection. The connection of the body 110 and the base 130 may further comprise a lock 142 to prevent unauthorized separation of the body 110 and the base 130 and access to the interior hollow portion 135.

As further shown in FIGS. 3 and 4, the underside 117 includes a battery compartment 119 and battery cover 118. The battery compartment 119 is generally centrally located on the underside 117. The battery compartment 119 is a size and shape suitable to receive batteries 150 sufficient to operate the memorial internment device 100. When the battery cover 118 is in the closed position, the batteries 150 are secure and the body 110 is able to fasten to the base 130 without interference from the objects or substances placed inside the inner base 133. The battery cover 118 may also comprise a lock 142 similar to that which is used to secure the body 110 to the base 130.

The battery compartment 119 has a circuit system connecting the batteries 150 to the bulb 120 and other components of the vessel 100 that require power. The compartment may also house a processor, memory, switch, wireless module and controller to operate the memorial device and control the functions of the vessel as more fully described in relation to FIG. 7 below. When the batteries 150 are engaged, the current is open to the bulb 120 and the bulb 120 is turned on or illuminated. When the batteries 150 are not engaged, the current is cut off from the bulb 120 and the bulb 120 is turned off or not illuminated. The controller can sequence the illumination device 120 through a series of different sequences depending on the preferences of the individual user. In addition, the illumination device 120 can be synched to operate in connection with the sound or video being heard or seen.

The circuit system may also be controlled through a switch, button, or sensor located on an exterior surface of the vessel 100. For example, when the switch or button is placed in the "ON" position, the current is sent to the bulb 120, thereby illuminating the same. Conversely, when the switch or button is in the "OFF" position, the electrical current is cut off from the bulb 120, and the bulb 120 turns off (i.e., is no longer illuminated). The vessel 100 may also have a sensor that is activated when the electrical current goes directly to the bulb 120 and turns the bulb 120 on. The sensor may be motion, light or sound-activated, or may be activated by touch. The sensor may also comprise a timer setting that allows the bulb 120 to remain illuminated for a user-selectable period of time, as well as to play the video or recordings from the speaker. The vessel 100 may also have a setting that allows the user 170 to set the desired time for the bulb 120, music, video or sound, to operate. In addition, a remote control or smart phone app may also allow the user 170 to turn on the bulb 120 as discussed elsewhere herein.

As best shown in FIG. 4, the battery cover 118 is repositionably fastened to the underside 117 through a hinge mechanism or other suitable method that allows the battery cover 118 to remain attached to the underside 117 on one side when in the open position and also allows the batteries 150 to be placed inside the battery compartment 119. In addition, the battery cover 118 may be fastened through a clasping mechanism, thereby allowing the battery cover 118 to be fully removed from the device 100 and reattached after the batteries 150 are inserted into the battery compartment 119. As previously noted, regardless of the method of attachment of the battery cover 118, a lock 142 may be provided to only permit the user 170 to have access to the compartment 119.

As also shown in FIG. 4, preferably two batteries 150 are inserted into the battery compartment 119. However, the battery compartment 119 may be configured to accommodate any type of battery 150 including, but not limited to, AAA, AA, C, D or 9-volt. The batteries 150 are placed in the battery compartment 119 such that the positive and negative ends correspond to the positive and negative terminals in the battery compartment 119. Once engaged, the batteries 150 will send power through the circuit system to the bulb 120 (or any other component that requires electrical power to function), thereby allowing the user 170 to turn the bulb 120 "ON" or "OFF" as desired.

FIG. 5 illustrates a partial perspective view of one potential embodiment of the illumination feature of the memorial internment vessel 100 of the present invention in accordance with the disclosed architecture. More specifically, the bulb 120 is shown inserted approximately in the center of the inside base 114. The bulb 120 is configured to fit snugly into the bulb opening 122. In a preferred embodiment, the bulb 120 is screwed in a clockwise direction into the bulb opening 122 until the bulb 120 can no longer turn, thereby connecting the bulb 120 with a circuit, or other electronic method, connected to the battery 150 that provides for the bulb 120 to illuminate when the battery 150 is engaged. As previously stated, the bulb 120 may also be illuminated through a switch or button that allows the current from the battery 150 to reach the bulb 120 when in the "ON" position.

Figure 6:
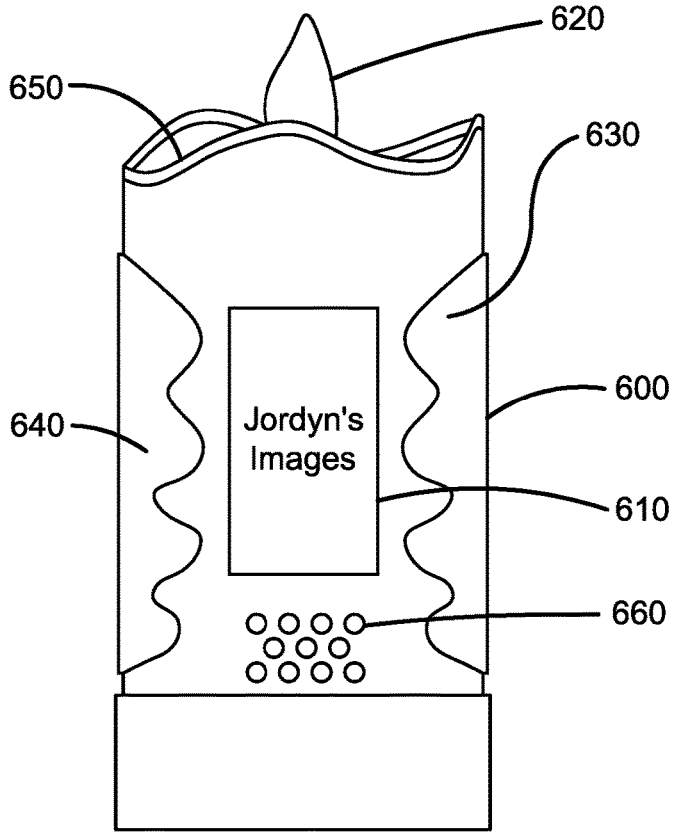
FIG. 6 illustrates a perspective view of one potential alternative embodiment of the memorial internment vessel of the present invention in accordance with the disclosed architecture, wherein the vessel further comprises a display screen and a deformable material portion.

FIG. 6 illustrates a perspective view of one potential alternative embodiment of the memorial internment vessel 100 of the present invention in accordance with the disclosed architecture, wherein the vessel 100 further comprises a display screen 610 and a deformable material portion 630, 640. In this embodiment, an illumination effect 620 is also shown mimicking an flame on top of a candle. A soft, pliable or other deformable material 630, 640 is applied to different portions of the body 110 so that an individual may grasp and hold the remembrance device 100 and the material will form around the individuals hands. The pliable or deformable material 630, 640 is preferably made from a polyurethane foam or other rubberized material. As previously stated, a reflective material 650 may also be provided near the illumination device to help increase the light generated by the bulb 120 in order to provide more of a glow. In addition, when the illumination device is cycled through the various sequences, the reflective material 650 can increase the flickering of the light during one of the sequences to enhance the effect of a flickering candle. The speaker 660 may be located at any point on the body 110 or base 130 of the memorial vessel 100.

Figure 7:
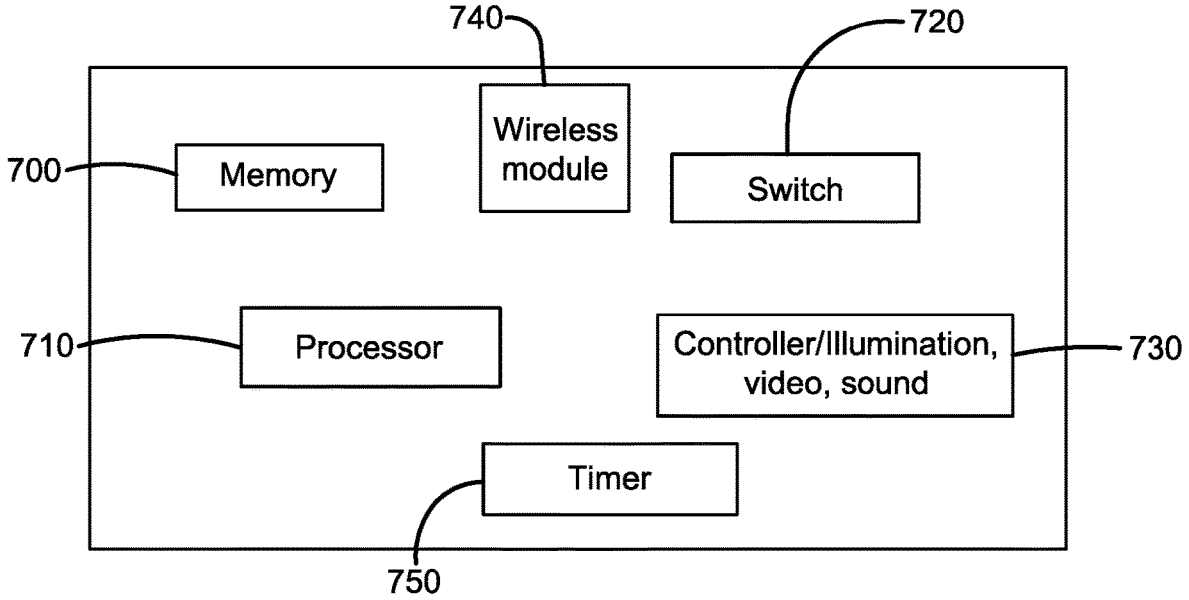
FIG. 7 illustrates a diagrammatic view of one potential embodiment of a control circuit of the memorial internment vessel of the present invention in accordance with the disclosed architecture.

FIG. 7 illustrates a diagrammatic view of one potential embodiment of a control circuit of the memorial internment vessel 100 of the present invention in accordance with the disclosed architecture. More specifically, a memory 700 is provided and may store sound and video images that the individual may want to display or hear from the vessel 100, and a processor 710 is included for retrieving the selected sounds or video that may be selected from a smart application downloaded to a smart phone, tablet or other electronic device. A switch 720 is included for turning the vessel 100 "ON" or "OFF", or to operate the various modes of the vessel 100, and a controller 730 is used to cycle or sequence the illumination device through the various sequences and operation of other features as elsewhere described herein. A wireless communication module 740 is included for connecting to a wireless device, such as a smart phone, tablet or the like, and a timer circuit 750 is included to allow a selection of intervals to play the sound, video or operate the illumination device.

It is also contemplated that the color of the memorial remembrance vessel 100 can be any color that satisfied user need and/or preference, and may be changed over time by the user. As stated above, it is also contemplated that wax may also surround the body 130 providing for a more authentic candle-like appearance, with a silver base wherein the cremations or remains would be stored. The silver base would also be capable of receiving an inscription.

Notwithstanding the forgoing, the memorial remembrance vessel or "Jordyn's candle" 100 of the present invention and its various components can be of any suitable size and configuration as is known in the art without affecting the overall concept of the invention, provided that they accomplish the above stated objectives. One of ordinary skill in the art will appreciate that the size, configuration, and material of the memorial remembrance vessel 100 and its various components as shown in the FIGS. are for illustrative purposes only, and that other configurations of the memorial remembrance vessel 100 are well within the scope of the present disclosure.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A memorial remembrance container comprising:

a body having a top surface, an underside having a bottom surface, and an inner wall coated with a prismatic film configured to reflect light;

a light mimicking a flame positioned at a center of the top surface;

a base having a cavity attached to the bottom surface, wherein the cavity contains at least one of a precious item, a relic or a plurality of ashes;

a speaker;

a switch for actuating at least one of the speaker or the light;

a memory;

a battery compartment disposed within the underside of the body, the battery compartment comprising a battery cover and a lock configured to secure the battery cover; and a rubberized hand deformable portion applied to a portion of the body.

* * * * *